US012503750B2

(12) United States Patent
Guo et al.

(10) Patent No.: US 12,503,750 B2
(45) Date of Patent: Dec. 23, 2025

(54) ALUMINUM ALLOY AND USE THEREOF

(71) Applicant: BYD COMPANY LIMITED, Guangdong (CN)

(72) Inventors: Qiang Guo, Shenzhen (CN); Mengde Wang, Shenzhen (CN); Wei An, Shenzhen (CN); Jingsong Fu, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 392 days.

(21) Appl. No.: 18/113,322

(22) Filed: Feb. 23, 2023

(65) Prior Publication Data

US 2023/0193429 A1 Jun. 22, 2023

Related U.S. Application Data

(63) Continuation of application No. PCT/CN2020/140824, filed on Dec. 29, 2020.

(30) Foreign Application Priority Data

Aug. 27, 2020 (CN) ..... 202010879782.6

(51) Int. Cl.
*C22C 21/02* (2006.01)
*C22F 1/043* (2006.01)

(52) U.S. Cl.
CPC ..... *C22C 21/02* (2013.01); *C22F 1/043* (2013.01)

(58) Field of Classification Search
CPC ..... C22C 21/02; C22F 1/043
See application file for complete search history.

(56) References Cited

U.S. PATENT DOCUMENTS

2005/0155676 A1 7/2005 Cosse et al.
2020/0115777 A1* 4/2020 Guo ..... C22C 1/026

FOREIGN PATENT DOCUMENTS

| | | | |
|---|---|---|---|
| CN | 105296818 | A | 2/2016 |
| CN | 105401009 | A | 3/2016 |
| CN | 105463269 | A | 4/2016 |
| CN | 105986152 | A | 10/2016 |
| CN | 107365926 | A | 11/2017 |
| CN | 108085541 | A | 5/2018 |
| CN | 108359855 | A | 8/2018 |
| CN | 108559881 | A | 9/2018 |
| CN | 108913962 | A | 11/2018 |
| CN | 109072353 | A | 12/2018 |
| CN | 110343916 | A | 10/2019 |
| CN | 110527871 | A | 12/2019 |
| CN | 110551925 | A | 12/2019 |
| CN | 110735071 | A | 1/2020 |
| JP | H01283335 | A | 11/1989 |
| JP | H05179384 | A | 7/1993 |
| KR | 20200023073 | A | 3/2020 |

OTHER PUBLICATIONS

International Search Report and Written Opinion for Application No. PCT/CN2020/140824, mailed on May 26, 2021, 12 pages.

* cited by examiner

*Primary Examiner* — Jessee R Roe
(74) *Attorney, Agent, or Firm* — Sheppard Mullin Richter & Hampton LLP

(57) ABSTRACT

An aluminum alloy and application thereof are disclosed. Based on a total mass of the aluminum alloy, the aluminum alloy includes: 7%-11% Si, 0.4%-1.0% Fe, 0.001%-0.2% Mg, 0.001%-0.2% Cu, 0.001%-0.2% Zn, 0.005%-0.1% Mn, 0.01%-0.06% Sr, 0.003%-0.05% B, 0.01%-0.02% Ga, 0.001%-0.01% Mo, 0.001%-0.2% Ce, 0.0003%-0.02% La, and balanced by aluminum and impurity elements, where a total amount of the impurity elements is less than 0.1%.

18 Claims, No Drawings

ALUMINUM ALLOY AND USE THEREOF

CROSS-REFERENCE TO RELATED APPLICATIONS

This application is a Continuation Application of International Patent Application No. PCT/CN2020/140824, filed on Dec. 29, 2020, which is based on and claims priority to and benefits of Chinese Patent Application No. 202010879782.6, filed with the China National Intellectual Property Administration on Aug. 27, 2020. The entire content of all of the above-identified applications is incorporated herein by reference.

FIELD

The present disclosure relates to the technical field of aluminum alloys, and more specifically, to an aluminum alloy and applications thereof.

BACKGROUND

Die casting is one of the basic methods for forming an aluminum alloy, which may be used for product design of complex structural parts. During die casting of the existing die-casting aluminum alloy material, it is often necessary to sacrifice the thermal conductivity of the material when considering all aspects of properties of the material, for example, mechanical properties such as a yield strength, a tensile strength, an elongation, and the like, which causes a decline of the heat dissipation of the existing die-casting aluminum alloy when being used as a heat dissipation material. Therefore, the existing die-casting aluminum alloy is not suitable for scenes with requirements for a high coefficient of thermal conductivity.

Therefore, the related art of the aluminum alloy still needs to be improved.

SUMMARY

For the problem that the existing aluminum alloy cannot give consideration to the requirements for both the mechanical properties and heat dissipation, the present disclosure provides an aluminum alloy and applications thereof.

According to a first aspect, the present disclosure provides an aluminum alloy. Based on a total mass of the aluminum alloy, the aluminum alloy includes: 7%-11% Si, 0.4%-1.0% Fe, 0.001%-0.2% Mg, 0.001%-0.2% Cu, 0.001%-0.2% Zn, 0.005%-0.1% Mn, 0.01%-0.06% Sr, 0.003%-0.05% B, 0.01%-0.02% Ga, 0.001%-0.01% Mo, 0.001%-0.2% Ce, 0.0003%-0.02% La, and balanced by aluminum and impurity elements, where a total amount of the impurity elements is less than 0.1%.

According to a second aspect, the present disclosure further provides a heat sink. The heat sink includes the above aluminum alloy.

According to the aluminum alloy provided in the present disclosure, by controlling the composition and contents of alloying elements, the aluminum alloy has a relatively high yield strength, tensile strength, and elongation, and a relatively high coefficient of thermal conductivity can be ensured without sacrificing various mechanical properties.

Some of the additional aspects and advantages of the present disclosure are given in the following description, and some will become apparent in the following description, or may be learned by practice of the present disclosure.

DETAILED DESCRIPTION

Endpoints and any value of the ranges disclosed herein are not limited to the precise range or value, and these ranges or values should be understood to include values close to these ranges or values. For value ranges, one or more new ranges of values may be obtained by combining the endpoint values of each range, combining the endpoint values of each range with individual point values, and combining the individual point values. These numerical ranges should be regarded as specifically disclosed herein.

In order to make the technical problems to be solved by embodiments of the present disclosure, technical solutions, and beneficial effects clearer, the present disclosure is further described in detail below with reference to the embodiments. It should be understood that, the embodiments described herein are merely used for explaining the present disclosure rather than limiting the present disclosure.

In an aspect of the present disclosure, the present disclosure provides an aluminum alloy. According to the embodiment of the present disclosure, based on the total mass of the aluminum alloy, the aluminum alloy includes: 7%-11% Si, 0.4%-1.0% Fe, 0.001%-0.2% Mg, 0.001%-0.2% Cu, 0.001%-0.2% Zn, 0.005%-0.1% Mn, 0.01%-0.06% Sr, 0.003%-0.05% B, 0.01%-0.02% Ga, 0.001%-0.01% Mo, 0.001%-0.2% Ce, 0.0003%-0.02% La, and balanced by aluminum and impurity elements, where a total amount of the impurity elements is less than 0.1%. According to the aluminum alloy provided in the present disclosure, by controlling the composition and contents of alloy elements, the aluminum alloy has a relatively high yield strength, tensile strength, and elongation, and a relatively high coefficient of thermal conductivity can be ensured without sacrificing various mechanical properties.

In some embodiments, a content of Si is 7.5%, 8.0%, 8.5%, 9.0%, 9.5%, 9.7%, or 10%, a content of Fe is 0.5%, 0.65%, 0.8%, or 0.9%, a content of Mg is 0.005%, 0.02%, 0.05%, 0.06%, 0.08%, 0.09%, 0.15%, or 0.18%, a content of Cu is 0.003%, 0.005%, 0.01%, 0.02%, 0.05%, 0.09%, 0.13%, or 0.18%, a content of Zn is 0.005%, 0.01%, 0.02%, 0.05%, 0.09%, 0.12%, or 0.17%, a content of Mn is 0.007%, 0.01%, 0.02%, 0.05%, 0.07%, or 0.09%, a content of Sr is 0.015%, 0.02%, 0.04%, 0.05%, or 0.06%, a content of B is 0.005%, 0.01%, 0.02%, 0.03%, 0.04%, or 0.05%, a content of Ga is 0.013%, 0.015%, or 0.018%, a content of Mo is 0.003%, 0.005%, 0.006%, or 0.009%, a content of Ce is 0.003%, 0.005%, 0.01%, 0.03%, 0.08%, 0.1%, 0.14%, or 0.18%, and a content of La is 0.0005%, 0.001%, 0.003%, 0.008%, 0.01%, 0.015%, or 0.018%.

The aluminum alloy in the present disclosure includes Si and Mg with the above contents, and an appropriate amount of a $Mg_2Si$ strengthening phase can be formed through the combination of Si and Mg. In this way, the heat conductivity of the aluminum alloy can be improved while ensuring the strength and good formability of the aluminum alloy, and the increase of crystal contents in the eutectic silicon structure of the aluminum alloy caused by an excessively high silicon content is avoided. The increase of crystal contents in eutectic silicon structure in the aluminum alloy increases the surface-to-surface contact between crystals, which easily leads to the problem of surface defects and affects the thermal conduction efficiency of electrons, resulting in the deterioration of the thermal conductivity of the aluminum alloy.

The aluminum alloy in the present disclosure includes Cu, Mg, and Mn with the above contents, which may cause a high dispersion of a Cu-rich phase, an Mg-rich phase, and an Mn-rich phase in the eutectic silicon in the aluminum alloy matrix, thereby improving the mechanical property of the aluminum alloy. In addition, an appropriate amount of an $Al_4Ce$ phase can be formed by the rare earth element Ce of the above content with Al and dispersedly distributed in the aluminum alloy matrix, which plays a role in grain refinement, and weakens the generation of an interference phase such as $\beta$-$Mg_{17}Al_{12}$. In this way, fewer impurity phases are generated, and the internal electron heat transfer efficiency of the material is high. In addition, latent heat of crystallization is released while the crystal is crystallizing, to cause a local temperature to rise. After a dendrite of a solid-liquid front is heated, a branch with higher surface energy melts at a position of necking and becomes free from a trunk, which prevents growth of the crystal. The dendrite then begins to change to a spherical shape, with an appearance similar to an appearance obtained through heat treatment, which facilitates improvement of the thermal conductivity and mechanical properties of the aluminum alloy. It should be noted that in the formula of the aluminum alloy of the present disclosure, the content of Ce should be controlled below 0.2%, to avoid a case that a volume fraction of $Al_4Ce$ phase particles is greatly increased when the content of Ce is excessively high. These hard particles of high melting temperature are broken in the hot extrusion process, edges and corners of the hard particles become sharp, and the morphology of the hard particles is close to the morphology of a needle-like Fe-rich phase, which has a great impact on the thermal conductivity of the aluminum alloy. In addition, an excessively high content of Ce may lead to stress concentration, and reduce the strength of the aluminum alloy.

The aluminum alloy in the present disclosure contains La with the above content, which has a good refining effect on the Cu-rich phase and the Mn-rich phase dispersed among crystals in the eutectic silicon structure, to improve the thermal conductivity and mechanical properties of the aluminum alloy. Further, when a mass ratio of La, Cu, and Mn satisfies 1:(0.4-24):(1-16), the thermal conductivity of the aluminum alloy can be further effectively improved.

In some implementations of the present disclosure, a mass ratio of Ce, La, Cu, Mg, and Mn in the aluminum alloy is (2-20):1:(1-10):(0.2-20):(1-10). In this case, the rare earths Ce and La can refine an $\alpha$-Al dendrite, the Cu-rich phase, and the Mn-rich phase, and further improve the comprehensive properties of the aluminum alloy.

The aluminum alloy in the present disclosure contains La with the above content, and may further generate a potential alloy strengthening phase of $Al_{11}La_3$. An effect of the alloy strengthening phase to modify and refine grains promotes the generation of a cubic phase $Al_5Cu_6Mg_2$ from elements Cu and Mg. The generation of the cubic phase causes the $\alpha$-Al matrix phase to be refined. The eutectic silicon structure is more similar to a sphere, which improves the shuttling efficiency of electrons. Further, when the mass sum of Cu and Mg accounts for 0.06%-0.22% of the total mass of the aluminum alloy, the refinement of the potential $Al_{11}La_3$ generated by the rare earth La relative to the cubic phase $Al_5Cu_6Mg_2$ can be further promoted.

The aluminum alloy disclosed by the present disclosure includes Fe and Mn with the above contents, which reduces the generation of a sheet-like impurity AlMnFeSi phase, and eliminates interference phases such as excess sedimentation and precipitation, and increases the shuttling efficiency of free electrons in the aluminum alloy, thereby improving the thermal conductivity of the aluminum alloy. Further, when a mass ratio of Ce and Fe satisfies (0.02-0.2):1, the transformation of the needle-like Fe-rich phase into fine particles can be further promoted, and the splitting effect of the needle-like Fe-rich phase relative to the crystal can be reduced, to cause the aluminum alloy to have good thermal conductivity and the fluidity of the aluminum alloy to be greatly improved, so as to form a complex die casting. It should be noted that in the formula of the aluminum alloy of the present disclosure, the content of Fe should be controlled below 1.0%, and the content of Mn should be controlled below 0.1%, to avoid the decrease of the thermal conductivity of the aluminum alloy caused by the aggregation of a large number of Cu-rich phases, Mn-rich phases, and needle-like Fe-rich phases.

In some implementations of the present disclosure, the sum of the mass of Mg, Mn, and Zn in the aluminum alloy accounts for 0.03%-0.26% of the total mass of the aluminum alloy. In this way, the rare earth Ce can promote the generation of the $Mg_7Zn_3Mn$—Ce phase. The generation of the phase plays a role in refining the $\alpha$-Al matrix phase, and may further shorten the Fe-rich phase, which not only weakens the splitting effect of the alloy matrix, but also helps improve the fluidity.

The content of Sr and B in the aluminum alloy in the present disclosure can optimize the internal structure of the aluminum alloy and improve the casting quality of the aluminum alloy. The addition of Sr and B in the present disclosure can cause coarse eutectic silicon to be finer and more fibrous, and the reaction between Al and B to produce $AlB_2$ can reduce the solid solution effect of impurity elements and promote the refinement of internal structure grains of the aluminum alloy, so as to improve the thermal conductivity of the material. In addition, the mechanical properties of the material are still good due to the grain refinement, which avoids the phenomenon that the mechanical properties of the material are greatly degraded after heat treatment. In addition, the addition of Ce and La in the present disclosure may also refine the grain, eliminate the harmful influence of trace impurities in the alloy, improve the thermal stability, and contribute to the improvement of the thermal conductivity of the aluminum alloy. It should be noted that in the formula of the aluminum alloy of the present disclosure, the content of Sr should be controlled below 0.06%, so as to prevent the crystal from producing certain defects due to excessive grain refinement, which greatly reduces the transfer efficiency of free electrons in the material and further degrades the thermal conductivity.

In the aluminum alloy of the present disclosure, the combined effect of Ce, La, B, and Sr further reduces the intergranular impurities in the material, optimizes the crystal morphology, and effectively improves the coefficient of thermal conductivity of the material. The combined effects of the four elements cause the aluminum alloy to obtain more excellent comprehensive properties. Further, a mass ratio of Sr, B, Ce, and La in the aluminum alloy is (8-12):(0.6-4):(10-20):1. Therefore, the mechanical properties and thermal conductivity of the aluminum alloy can be further improved.

In some implementations of the present disclosure, based on the total mass of the aluminum alloy, the aluminum alloy includes: 7.5%-10% Si, 0.4%-1.0% Fe, 0.001%-0.1% Mg, 0.002%-0.15% Cu, 0.001%-0.1% Zn, 0.005%-0.08% Mn, 0.01%-0.05% Sr, 0.003%-0.05% B, 0.01%-0.02% Ga, 0.001%-0.01% Mo, 0.001%-0.15% Ce, 0.0003%-0.005% La, and balanced by aluminum and impurity elements, and a total amount of the impurity elements is less than 0.1%. Therefore, the components in the aluminum alloy cooperate with each other to achieve the optimal synergistic effect, thereby further improving the yield strength, the tensile strength, the elongation, and the coefficient of thermal conductivity of the aluminum alloy.

In some implementations of the present disclosure, a yield strength of the aluminum alloy is in a range of 112 Mpa-131 Mpa, a tensile strength of the aluminum alloy is in a range of 220 Mpa-253 Mpa, an elongation of the aluminum alloy is in a range of 8%-15%, and a coefficient of thermal conductivity of the aluminum alloy is in a range of 201 W/(m k)-210 W/(m k).

The present disclosure provides a method for preparing the aluminum alloy, including the following operating steps: weighing raw materials in a required proportion according to a proportion of elements in the aluminum alloy, adding the raw materials to a smelting furnace for smelting, performing casting after slag removal and refining degassing treatment to obtain an aluminum alloy ingot, and then performing die-casting molding on the aluminum alloy ingot, so as to obtain the yield strength of the aluminum alloy in a range of 135 Mpa-165 Mpa, the tensile strength in a range of 280 Mpa-320 Mpa, the elongation in a range of 8%-15%, and the coefficient of thermal conductivity in a range of 180 W/(m·k)-190 W/(m·k).

In some embodiments, heat treatment is performed on the aluminum alloy after the die-casting molding, and the heat treatment process conditions include: the temperature is in a range of 200° C.-320° C., the time is 2.5-3 h, the yield strength is in a range of 112 Mpa-131 Mpa, the tensile strength is in a range of 220 Mpa-253 Mpa, the elongation is in a range of 8%-15%, and the coefficient of thermal conductivity is in a range of 201 W/(m k)-210 W/(m k) after the heat treatment of the aluminum alloy.

In the method for preparing the aluminum alloy in the present disclosure, the raw materials include an Al-containing material, an Si-containing material, an Fe-containing material, an Mg-containing material, a Cu-containing material, a Zn-containing material, an Mn-containing material, a Sr-containing material, a B-containing material, a Ga-containing material, a Mo-containing material, a Ce-containing material, and an La-containing material. In the present disclosure, the Al-containing material, the Si-containing material, the Fe-containing material, the Mg-containing material, the Cu-containing material, the Zn-containing material, the Mn-containing material, the Sr-containing material, the B-containing material, the Ga-containing material, the Mo-containing material, the Ce-containing material, and the La-containing material may be materials that can provide various elements required for preparing the die-casting aluminum alloy of the present disclosure, and may be alloys or pure metals containing the above elements, as long as the components in the aluminum alloy obtained by melting the added aluminum alloy raw materials are within the above range.

According to a second aspect of the present disclosure, the present disclosure provides a heat sink. According to the embodiment of the present disclosure, the heat sink includes the aluminum alloy. Therefore, by applying the aluminum alloy to the heat sink, the heat dissipation effect of the heat sink can be effectively improved, and it is also ensured that the heat sink has better mechanical properties.

The present disclosure is described below with reference to specific embodiments. It is to be noted that these embodiments are merely illustrative and do not limit the present disclosure in any way.

Embodiments 1-34

As shown in Table 1, based on a total mass of an aluminum alloy, the aluminum alloy includes the following components: a content of Si in a range of 7%-11%, a content of Fe in a range of 0.4%-1.0%, a content of Mg in a range of 0.001%-0.2%, a content of Cu in a range of 0.001%-0.2%, a content of Zn in a range of 0.001%-0.2%, a content of Mn in a range of 0.005%-0.1%, a content of Sr in a range of 0.01%-0.06%, a content of B in a range of 0.003%-0.05%, a content of Ga in a range of 0.01%-0.02%, a content of Mo in a range of 0.001%-0.01%, a content of Ce in a range of 0.001%-0.2%, a content of La in a range of 0.0003%-0.02%, balanced by Al and impurities, and a content of the impurities below 0.1%. The required mass of various intermediate alloys or metal elements is calculated according to the mass content of the composition of the above aluminum alloy, then the intermediate alloys or metal elements are added to a smelting furnace for smelting, a slag removal agent is added to the molten metal for slag removal, then a refining agent is added to the molten metal for the operation of refining and degassing, and an aluminum alloy ingot is obtained by casting, and then the aluminum alloy ingot is formed through die casting (in an F state). Heat treatment is performed on the die-casting aluminum alloy at 300° C. for 2.5 h.

Comparative Examples 1-23

The die-casting aluminum alloy is prepared by using the same method as that in the embodiment. A difference is that raw materials of the aluminum alloy are prepared according to the composition in Table 1.

TABLE 1

| Formula of aluminum alloy (unit: weight fraction) | | | | | | | | | | | | | |
|---|---|---|---|---|---|---|---|---|---|---|---|---|---|
| | Si | Mg | Fe | Sr | B | Mn | Cu | Zn | Ga | Mo | La | Ce | impurities and aluminum |
| Embodiment 1 | 9 | 0.05 | 0.5 | 0.04 | 0.01 | 0.05 | 0.05 | 0.02 | 0.02 | 0.003 | 0.005 | 0.1 | Other impurities <0.1 |
| Embodiment 2 | 8 | 0.05 | 0.5 | 0.04 | 0.01 | 0.05 | 0.05 | 0.02 | 0.02 | 0.003 | 0.005 | 0.1 | Other impurities <0.1 |
| Embodiment 3 | 10 | 0.05 | 0.5 | 0.04 | 0.01 | 0.05 | 0.05 | 0.02 | 0.02 | 0.003 | 0.005 | 0.1 | Other impurities <0.1 |
| Embodiment 4 | 9 | 0.1 | 0.5 | 0.04 | 0.01 | 0.05 | 0.05 | 0.02 | 0.02 | 0.003 | 0.005 | 0.1 | Other impurities <0.1 |

TABLE 1-continued

| Formula of aluminum alloy (unit: weight fraction) | | | | | | | | | | | | | |
|---|---|---|---|---|---|---|---|---|---|---|---|---|---|
| | Si | Mg | Fe | Sr | B | Mn | Cu | Zn | Ga | Mo | La | Ce | impurities and aluminum |
| Embodiment 5 | 9 | 0.05 | 0.7 | 0.04 | 0.01 | 0.05 | 0.05 | 0.02 | 0.02 | 0.003 | 0.005 | 0.1 | Other impurities <0.1 |
| Embodiment 6 | 9 | 0.05 | 1 | 0.04 | 0.01 | 0.05 | 0.05 | 0.02 | 0.02 | 0.003 | 0.005 | 0.1 | Other impurities <0.1 |
| Embodiment 7 | 9 | 0.05 | 0.5 | 0.05 | 0.01 | 0.05 | 0.05 | 0.02 | 0.02 | 0.003 | 0.005 | 0.1 | Other impurities <0.1 |
| Embodiment 8 | 9 | 0.05 | 0.5 | 0.04 | 0.003 | 0.05 | 0.05 | 0.02 | 0.02 | 0.003 | 0.005 | 0.1 | Other impurities <0.1 |
| Embodiment 9 | 9 | 0.05 | 0.5 | 0.04 | 0.02 | 0.05 | 0.05 | 0.02 | 0.02 | 0.003 | 0.005 | 0.1 | Other impurities <0.1 |
| Embodiment 10 | 9 | 0.05 | 0.5 | 0.04 | 0.01 | 0.01 | 0.05 | 0.02 | 0.02 | 0.003 | 0.005 | 0.1 | Other impurities <0.1 |
| Embodiment 11 | 9 | 0.05 | 0.5 | 0.04 | 0.01 | 0.03 | 0.05 | 0.02 | 0.02 | 0.003 | 0.005 | 0.1 | Other impurities <0.1 |
| Embodiment 12 | 9 | 0.05 | 0.5 | 0.04 | 0.01 | 0.05 | 0.01 | 0.02 | 0.02 | 0.003 | 0.005 | 0.1 | Other impurities <0.1 |
| Embodiment 13 | 9 | 0.05 | 0.5 | 0.04 | 0.01 | 0.05 | 0.03 | 0.02 | 0.02 | 0.003 | 0.005 | 0.1 | Other impurities <0.1 |
| Embodiment 14 | 9 | 0.05 | 0.5 | 0.04 | 0.01 | 0.05 | 0.05 | 0.01 | 0.02 | 0.003 | 0.005 | 0.1 | Other impurities <0.1 |
| Embodiment 15 | 9 | 0.05 | 0.5 | 0.04 | 0.01 | 0.05 | 0.05 | 0.05 | 0.02 | 0.003 | 0.005 | 0.1 | Other impurities <0.1 |
| Embodiment 16 | 9 | 0.05 | 0.5 | 0.04 | 0.01 | 0.05 | 0.05 | 0.1 | 0.02 | 0.003 | 0.005 | 0.1 | Other impurities <0.1 |
| Embodiment 17 | 9 | 0.05 | 0.5 | 0.04 | 0.01 | 0.05 | 0.05 | 0.02 | 0.01 | 0.003 | 0.005 | 0.1 | Other impurities <0.1 |
| Embodiment 18 | 9 | 0.05 | 0.5 | 0.04 | 0.01 | 0.05 | 0.05 | 0.02 | 0.02 | 0.005 | 0.005 | 0.1 | Other impurities <0.1 |
| Embodiment 19 | 9 | 0.05 | 0.5 | 0.04 | 0.01 | 0.05 | 0.05 | 0.02 | 0.02 | 0.008 | 0.005 | 0.1 | Other impurities <0.1 |
| Embodiment 20 | 9 | 0.05 | 0.5 | 0.04 | 0.01 | 0.05 | 0.01 | 0.02 | 0.02 | 0.003 | 0.003 | 0.03 | Other impurities <0.1 |
| Embodiment 21 | 9 | 0.05 | 0.5 | 0.04 | 0.01 | 0.05 | 0.01 | 0.02 | 0.02 | 0.003 | 0.001 | 0.015 | Other impurities <0.1 |
| Embodiment 22 | 9 | 0.2 | 0.5 | 0.04 | 0.01 | 0.05 | 0.02 | 0.02 | 0.02 | 0.003 | 0.005 | 0.1 | Other impurities <0.1 |
| Embodiment 23 | 9 | 0.05 | 0.5 | 0.04 | 0.01 | 0.05 | 0.05 | 0.02 | 0.02 | 0.003 | 0.01 | 0.1 | Other impurities <0.1 |
| Embodiment 24 | 9 | 0.05 | 0.5 | 0.04 | 0.01 | 0.08 | 0.05 | 0.02 | 0.02 | 0.003 | 0.002 | 0.04 | Other impurities <0.1 |
| Embodiment 25 | 9 | 0.05 | 0.5 | 0.04 | 0.01 | 0.05 | 0.15 | 0.02 | 0.02 | 0.003 | 0.005 | 0.1 | Other impurities <0.1 |
| Embodiment 26 | 9 | 0.1 | 0.5 | 0.04 | 0.01 | 0.05 | 0.01 | 0.02 | 0.02 | 0.003 | 0.002 | 0.02 | Other impurities <0.1 |
| Embodiment 27 | 9 | 0.05 | 0.5 | 0.04 | 0.01 | 0.07 | 0.05 | 0.02 | 0.02 | 0.003 | 0.005 | 0.1 | Other impurities <0.1 |
| Embodiment 28 | 9 | 0.05 | 0.5 | 0.04 | 0.01 | 0.05 | 0.12 | 0.02 | 0.02 | 0.003 | 0.005 | 0.1 | Other impurities <0.1 |

TABLE 1-continued

| | Formula of aluminum alloy (unit: weight fraction) | | | | | | | | | | | | |
|---|---|---|---|---|---|---|---|---|---|---|---|---|---|
| | Si | Mg | Fe | Sr | B | Mn | Cu | Zn | Ga | Mo | La | Ce | impurities and aluminum |
| Embodiment 29 | 9 | 0.001 | 0.5 | 0.04 | 0.01 | 0.05 | 0.05 | 0.02 | 0.02 | 0.003 | 0.005 | 0.1 | Other impurities <0.1 |
| Embodiment 30 | 9 | 0.05 | 0.5 | 0.04 | 0.01 | 0.05 | 0.005 | 0.02 | 0.02 | 0.003 | 0.005 | 0.1 | Other impurities <0.1 |
| Embodiment 31 | 9 | 0.05 | 0.4 | 0.04 | 0.01 | 0.05 | 0.05 | 0.02 | 0.02 | 0.003 | 0.005 | 0.1 | Other impurities <0.1 |
| Embodiment 32 | 9 | 0.05 | 0.5 | 0.02 | 0.01 | 0.05 | 0.05 | 0.02 | 0.02 | 0.003 | 0.005 | 0.1 | Other impurities <0.1 |
| Embodiment 33 | 9 | 0.05 | 0.5 | 0.04 | 0.04 | 0.05 | 0.05 | 0.02 | 0.02 | 0.003 | 0.005 | 0.1 | Other impurities <0.1 |
| Embodiment 34 | 9 | 0.05 | 0.5 | 0.04 | 0.01 | 0.05 | 0.05 | 0.2 | 0.02 | 0.003 | 0.005 | 0.1 | Other impurities <0.1 |
| Comparative example 1 | 12 | 0.05 | 0.5 | 0.04 | 0.01 | 0.05 | 0.05 | 0.02 | 0.02 | 0.003 | 0.005 | 0.1 | Other impurities <0.1 |
| Comparative example 2 | 6 | 0.05 | 0.5 | 0.04 | 0.01 | 0.05 | 0.05 | 0.02 | 0.02 | 0.003 | 0.005 | 0.1 | Other impurities <0.1 |
| Comparative example 3 | 9 | 0.4 | 0.5 | 0.04 | 0.01 | 0.05 | 0.05 | 0.02 | 0.02 | 0.003 | 0.005 | 0.1 | Other impurities <0.1 |
| Comparative example 4 | 9 | 0 | 0.5 | 0.04 | 0.01 | 0.05 | 0.05 | 0.02 | 0.02 | 0.003 | 0.005 | 0.1 | Other impurities <0.1 |
| Comparative example 5 | 9 | 0.05 | 1.5 | 0.04 | 0.01 | 0.05 | 0.05 | 0.02 | 0.02 | 0.003 | 0.005 | 0.1 | Other impurities <0.1 |
| Comparative example 6 | 9 | 0.05 | 0.5 | 0.1 | 0.01 | 0.05 | 0.05 | 0.02 | 0.02 | 0.003 | 0.005 | 0.1 | Other impurities <0.1 |
| Comparative example 7 | 9 | 0.05 | 0.5 | 0 | 0.01 | 0.05 | 0.05 | 0.02 | 0.02 | 0.003 | 0.005 | 0.1 | Other impurities <0.1 |
| Comparative example 8 | 9 | 0.05 | 0.5 | 0.04 | 0.1 | 0.05 | 0.05 | 0.02 | 0.02 | 0.003 | 0.005 | 0.1 | Other impurities <0.1 |
| Comparative example 9 | 9 | 0.05 | 0.5 | 0.04 | 0 | 0.05 | 0.05 | 0.02 | 0.02 | 0.003 | 0.005 | 0.1 | Other impurities <0.1 |
| Comparative example 10 | 9 | 0.05 | 0.5 | 0.04 | 0.01 | 0.3 | 0.05 | 0.02 | 0.02 | 0.003 | 0.005 | 0.1 | Other impurities <0.1 |
| Comparative example 11 | 9 | 0.05 | 0.5 | 0.04 | 0.01 | 0 | 0.05 | 0.02 | 0.02 | 0.003 | 0.005 | 0.1 | Other impurities <0.1 |
| Comparative example 12 | 9 | 0.05 | 0.5 | 0.04 | 0.01 | 0.05 | 0.4 | 0.02 | 0.02 | 0.003 | 0.005 | 0.1 | Other impurities <0.1 |
| Comparative example 13 | 9 | 0.05 | 0.5 | 0.04 | 0.01 | 0.05 | 0 | 0.02 | 0.02 | 0.003 | 0.005 | 0.1 | Other impurities <0.1 |
| Comparative example 14 | 9 | 0.05 | 0.5 | 0.04 | 0.01 | 0.05 | 0.05 | 0.4 | 0.02 | 0.003 | 0.005 | 0.1 | Other impurities <0.1 |
| Comparative example 15 | 9 | 0.05 | 0.5 | 0.04 | 0.01 | 0.05 | 0.05 | 0 | 0.02 | 0.003 | 0.005 | 0.1 | Other impurities <0.1 |
| Comparative example 16 | 9 | 0.05 | 0.5 | 0.04 | 0.01 | 0.05 | 0.05 | 0.02 | 0.2 | 0.003 | 0.005 | 0.1 | Other impurities <0.1 |
| Comparative example 17 | 9 | 0.05 | 0.5 | 0.04 | 0.01 | 0.05 | 0.05 | 0.02 | 0 | 0.003 | 0.005 | 0.1 | Other impurities <0.1 |
| Comparative example 18 | 9 | 0.05 | 0.5 | 0.04 | 0.01 | 0.05 | 0.05 | 0.02 | 0.02 | 0.1 | 0.005 | 0.1 | Other impurities <0.1 |

TABLE 1-continued

| Formula of aluminum alloy (unit: weight fraction) | | | | | | | | | | | | | |
|---|---|---|---|---|---|---|---|---|---|---|---|---|---|
| | Si | Mg | Fe | Sr | B | Mn | Cu | Zn | Ga | Mo | La | Ce | impurities and aluminum |
| Comparative example 19 | 9 | 0.05 | 0.5 | 0.04 | 0.01 | 0.05 | 0.05 | 0.02 | 0.02 | 0 | 0.005 | 0.1 | Other impurities <0.1 |
| Comparative example 20 | 9 | 0.05 | 0.5 | 0.04 | 0.01 | 0.05 | 0.05 | 0.02 | 0.02 | 0.003 | 0.1 | 0.1 | Other impurities <0.1 |
| Comparative example 21 | 9 | 0.05 | 0.5 | 0.04 | 0.01 | 0.05 | 0.05 | 0.02 | 0.02 | 0.003 | 0 | 0.1 | Other impurities <0.1 |
| Comparative example 22 | 9 | 0.05 | 0.5 | 0.04 | 0.01 | 0.05 | 0.05 | 0.02 | 0.02 | 0.003 | 0.005 | 0.4 | Other impurities <0.1 |
| Comparative example 23 | 9 | 0.05 | 0.5 | 0.04 | 0.01 | 0.05 | 0.05 | 0.02 | 0.02 | 0.003 | 0.005 | 0 | Other impurities <0.1 |

Performance Test

Tensile Strength Test:

The "GB/T 228.1-2010 Metallic materials-Tensile testing-Part 1: A method of test at room temperature" is adopted to test a tensile strength, a yield strength, and an elongation of a material.

Test for coefficient of thermal conductivity:

The aluminum alloy is made into a ϕ12.7×3 mm ingot heat-conducting wafer, graphite coatings are uniformly sprayed on two sides of a to-be-tested sample, and the processed sample is put into a laser thermal conductivity meter for testing. A laser thermal conductivity test is carried out according to the "ASTM E1461 Standard Test Method for Thermal Diffusivity by the Flash Method".

The results of the performance test performed on the aluminum alloys prepared in the above Embodiments 1-34 and Comparative examples 1-23 are shown in Table 2:

TABLE 2

| | F state | | | | 300° C. 2.5 h | | | |
|---|---|---|---|---|---|---|---|---|
| | Yield strength (MPa) | Tensile strength (MPa) | Elongation (%) | Coefficient of thermal conductivity (W/(m · k)) | Yield strength (MPa) | Tensile strength (MPa) | Elongation (%) | Coefficient of thermal conductivity (W/(m · k)) |
| Embodiment 1 | 158 | 307 | 9.98 | 185.3 | 129 | 247 | 9.74 | 209.3 |
| Embodiment 2 | 150 | 298 | 12.1 | 185.1 | 124 | 243 | 12.35 | 209 |
| Embodiment 3 | 154 | 304 | 10.46 | 183.8 | 125 | 241 | 8.96 | 206.9 |
| Embodiment 4 | 157 | 305 | 13.7 | 182 | 131 | 251 | 12.9 | 205.4 |
| Embodiment 5 | 153 | 301 | 10.2 | 184 | 124 | 239 | 11.86 | 207 |
| Embodiment 6 | 151 | 296 | 10.58 | 182 | 120 | 233 | 9.1 | 204.7 |
| Embodiment 7 | 159 | 304 | 11.12 | 182.5 | 131 | 250 | 12.1 | 205.1 |
| Embodiment 8 | 152 | 299 | 12.5 | 184 | 122 | 236.5 | 10.56 | 205 |
| Embodiment 9 | 158 | 308 | 13.5 | 183 | 130 | 249 | 13.7 | 204 |
| Embodiment 10 | 157 | 306 | 12.8 | 182.7 | 128 | 246 | 10.6 | 206 |
| Embodiment 11 | 155 | 304 | 10.21 | 183.1 | 127 | 245 | 13.1 | 207.3 |
| Embodiment 12 | 152 | 298 | 13.68 | 182 | 121 | 234 | 9.9 | 204 |
| Embodiment 13 | 156 | 299 | 9.3 | 184 | 126 | 244 | 8.9 | 204.1 |
| Embodiment 14 | 155 | 301 | 13.9 | 183 | 127 | 245 | 14.6 | 206 |
| Embodiment 15 | 159 | 303 | 9.6 | 184.2 | 125 | 240 | 9.56 | 208 |
| Embodiment 16 | 153 | 300 | 14.8 | 184 | 122 | 239 | 12.6 | 205 |
| Embodiment 17 | 154 | 304 | 8.89 | 182 | 125 | 244 | 12.1 | 207.1 |

TABLE 2-continued

| | F state | | | | 300° C. 2.5 h | | | |
|---|---|---|---|---|---|---|---|---|
| | Yield strength (MPa) | Tensile strength (MPa) | Elongation (%) | Coefficient of thermal conductivity (W/(m · k)) | Yield strength (MPa) | Tensile strength (MPa) | Elongation (%) | Coefficient of thermal conductivity (W/(m · k)) |
| Embodiment 18 | 156 | 303 | 12.6 | 184 | 127 | 239 | 12.74 | 206 |
| Embodiment 19 | 153 | 300 | 15 | 183 | 124 | 234 | 9.3 | 205 |
| Embodiment 20 | 155 | 294 | 11.37 | 181.5 | 125 | 233 | 12.7 | 203 |
| Embodiment 21 | 158 | 306 | 9.98 | 184 | 128 | 246 | 8.8 | 207 |
| Embodiment 22 | 155 | 291 | 10.63 | 180.1 | 131 | 251 | 9.74 | 201 |
| Embodiment 23 | 156 | 305 | 9.7 | 180 | 126 | 236 | 11.7 | 202.1 |
| Embodiment 24 | 149 | 294 | 10 | 182 | 117 | 226 | 13.7 | 203.1 |
| Embodiment 25 | 148 | 293 | 10.76 | 181 | 116 | 227.5 | 13.6 | 202 |
| Embodiment 26 | 153 | 290 | 8.9 | 180 | 125 | 234 | 13.5 | 20 |
| Embodiment 27 | 152 | 293 | 10.93 | 182 | 126 | 237 | 12.5 | 201.2 |
| Embodiment 28 | 147 | 290 | 10.8 | 182 | 114 | 225.5 | 14.2 | 202.7 |
| Embodiment 29 | 156 | 304 | 10.6 | 182 | 113 | 227 | 12.5 | 202 |
| Embodiment 30 | 147 | 29 | 11.86 | 182.1 | 113.5 | 224 | 11.7 | 20 |
| Embodiment 31 | 150 | 297 | 14.21 | 181 | 118 | 230 | 13.9 | 202.7 |
| Embodiment 32 | 148 | 289 | 10.9 | 182 | 117 | 229 | 11.5 | 201 |
| Embodiment 33 | 154 | 302 | 8.6 | 181 | 123 | 237 | 10.26 | 201.2 |
| Embodiment 34 | 155 | 310 | 12.1 | 181 | 126 | 243.7 | 10 | 201 |
| Comparative example 1 | 148 | 293 | 7.5 | 172 | 120 | 236 | 7.8 | 186.5 |
| Comparative example 2 | 134 | 270 | 14.5 | 187 | 108 | 214 | 7.2 | 211 |
| Comparative example 3 | 154 | 281 | 14.7 | 160 | 137 | 256 | 8.6 | 187.2 |
| Comparative example 4 | 147 | 294 | 8.98 | 179 | 116 | 223 | 10 | 193 |
| Comparative example 5 | 130 | 272 | 4.5 | 172.2 | 109 | 213 | 4 | 186 |
| Comparative example 6 | 142 | 287 | 8.2 | 168 | 113 | 223 | 7 | 189 |
| Comparative example 7 | 131 | 270 | 13.6 | 177 | 109 | 211 | 12 | 186 |
| Comparative example 8 | 149 | 293 | 7.7 | 168 | 120 | 230 | 9.3 | 173 |
| Comparative example 9 | 145 | 291 | 12.6 | 178 | 114 | 224 | 10.1 | 187 |
| Comparative example 10 | 150 | 308 | 8.2 | 170 | 122 | 228 | 9.7 | 180 |
| Comparative example 11 | 148 | 294 | 12.6 | 172 | 116 | 227 | 12.75 | 183 |
| Comparative example 12 | 144 | 289 | 7.5 | 158 | 113 | 221 | 8.6 | 174.5 |
| Comparative example 13 | 135 | 278 | 9.8 | 178.5 | 109 | 215 | 10.7 | 196 |
| Comparative example 14 | 147 | 291 | 9.1 | 165 | 118 | 229 | 8 | 177 |
| Comparative example 15 | 135 | 279 | 7.7 | 178.3 | 108 | 214 | 9.74 | 195 |
| Comparative example 16 | 144 | 288 | 8.7 | 163 | 113 | 223 | 7.6 | 182 |
| Comparative example 17 | 127 | 266 | 10.93 | 177 | 103 | 202 | 10.74 | 195 |
| Comparative example 18 | 148 | 302 | 9.4 | 170 | 118 | 225.7 | 7.8 | 188 |
| Comparative example 19 | 139 | 278 | 12.7 | 172 | 109 | 213 | 10.74 | 190 |

TABLE 2-continued

| | F state | | | | 300° C. 2.5 h | | | |
|---|---|---|---|---|---|---|---|---|
| | Yield strength (MPa) | Tensile strength (MPa) | Elongation (%) | Coefficient of thermal conductivity (W/(m · k)) | Yield strength (MPa) | Tensile strength (MPa) | Elongation (%) | Coefficient of thermal conductivity (W/(m · k)) |
| Comparative example 20 | 143 | 286 | 7.9 | 163 | 113 | 218 | 7 | 182 |
| Comparative example 21 | 130 | 273 | 11 | 170 | 107 | 206 | 10.3 | 175 |
| Comparative example 22 | 134 | 277 | 8.3 | 179 | 106 | 205 | 7.7 | 195 |
| Comparative example 23 | 145 | 263 | 8.77 | 176 | 115 | 217 | 6.9 | 196 |

It can be seen from the test results in Table 2 that the aluminum alloy provided in the present disclosure has a higher yield strength, tensile strength, and elongation than the aluminum alloy having the element ranges outside of those provided in the present disclosure, and also has better thermal conductivity. In particular, the aluminum alloy provided in the present disclosure has excellent thermal conductivity, and is particularly suitable for application to a heat dissipation material.

Implementations of the present disclosure are described in detail above. However, the present disclosure is not limited to specific details of the foregoing implementations. A plurality of variations may be made to the technical solutions of the present disclosure within the scope of the technical idea of the present disclosure. These variations all fall within the protection scope of the present disclosure.

In addition, it should be noted that the specific technical features described in the foregoing specific implementations may be combined in any proper manner in the case of no contradiction. In order to avoid unnecessary repetition, various possible combinations are not described separately in the present disclosure.

In addition, various different implementations of the present disclosure may also be combined without departing from the idea of the present disclosure, and the combinations shall still be regarded as the content disclosed in the present disclosure.

In the description of this specification, the description of the reference terms "an embodiment", "some embodiments", "an example", "a specific example", "some examples," and the like means that specific features, structures, materials, or characteristics described in combination with the embodiment or example are included in at least one embodiment or example of the present disclosure. In this specification, schematic descriptions of the foregoing terms are not necessarily directed at the same embodiment or example. Besides, the specific features, the structures, the materials, or the characteristics that are described may be combined in proper manners in any one or more embodiments or examples. In addition, a person skilled in the art may integrate or combine different embodiments or examples described in this specification and features of the different embodiments or examples as long as they do not contradict each other.

Although the embodiments of the present disclosure have been shown and described above, it can be understood that, the foregoing embodiments are exemplary and should not be understood as limitation to the present disclosure. A person of ordinary skill in the art can make changes, modifications, replacements, or variations to the foregoing embodiments within the scope of the present disclosure.

What is claimed is:

1. An aluminum alloy, based on a total mass of the aluminum alloy, the aluminum alloy comprising:

7%-11% Si;
0.4%-1.0% Fe;
0.001%-0.2% Mg;
0.001%-0.2% Cu;
0.001%-0.2% Zn;
0.005%-0.1% Mn;
0.01%-0.06% Sr;
0.003%-0.05% B;
0.01%-0.02% Ga;
0.001%-0.01% Mo;
0.001%-0.2% Ce;
0.0003%-0.02% La; and
balanced by aluminum and impurity elements, wherein a total amount of the impurity elements is less than 0.1%.

2. The aluminum alloy according to claim 1, based on the total mass of the aluminum alloy, the aluminum alloy comprising:

7.5%-10% Si;
0.4%-1.0% Fe;
0.001%-0.10% Mg;
0.002%-0.15% Cu;
0.001%-0.10% Zn;
0.005%-0.08% Mn;
0.01%-0.05% Sr;
0.003%-0.05% B;
0.01%-0.02% Ga;
0.001%-0.01% Mo;
0.001%-0.15% Ce;
0.0003%-0.005% La; and
balanced by aluminum and impurity elements, wherein a total amount of the impurity elements is less than 0.1%.

3. The aluminum alloy according to claim 1, wherein a mass ratio of La, Cu, and Mn is 1:(0.4-24):(1-16).

4. The aluminum alloy according to claim 1, wherein a mass ratio of Ce, La, Cu, Mg, and Mn is (2-20):1:(1-10):(0.2-20):(1-10).

5. The aluminum alloy according to claim 1, wherein a mass sum of Cu and Mg is 0.06%-0.22% of the total mass of the aluminum alloy.

6. The aluminum alloy according to claim 1, wherein a mass ratio of Ce and Fe is (0.02-0.2):1.

7. The aluminum alloy according to claim 1, wherein a mass sum of Mg, Mn, and Zn is 0.03%-0.26% of the total mass of the aluminum alloy.

8. The aluminum alloy according to claim 1, wherein a mass ratio of Sr, B, Ce, and La is (8-12):(0.6-4):(10-20):1.

9. The aluminum alloy according to claim 1, wherein a yield strength of the aluminum alloy is in a range of 112 Mpa-131 Mpa, a tensile strength of the aluminum alloy is in a range of 220 Mpa-253 Mpa, an elongation of the aluminum alloy is in a range of 8%-15%, and a coefficient of thermal conductivity of the aluminum alloy is in a range of 201 W/(m k)-210 W/(m k).

10. A heat sink, comprising an aluminum alloy, wherein, based on a total mass of the aluminum alloy, the aluminum alloy comprises:

7%-11% Si;
0.4%-1.0% Fe;
0.001%-0.2% Mg;
0.001%-0.2% Cu;
0.001%-0.2% Zn;
0.005%-0.1% Mn;
0.01%-0.06% Sr;
0.003%-0.05% B;
0.01%-0.02% Ga;
0.001%-0.01% Mo;
0.001%-0.2% Ce;
0.0003%-0.02% La; and
balanced by aluminum and impurity elements, wherein a total amount of the impurity elements is less than 0.1%.

11. The heat sink according to claim 10, wherein the aluminum alloy further comprising:

7.5%-10% Si;
0.4%-1.0% Fe;
0.0010%-0.10% Mg;
0.002%-0.15% Cu;
0.0010%-0.10% Zn;
0.005%-0.08% Mn;
0.01%-0.05% Sr;
0.003%-0.05% B;
0.01%-0.02% Ga;
0.001%-0.01% Mo;
0.001%-0.15% Ce;
0.0003%-0.005% La; and
balanced by aluminum and impurity elements, wherein a total amount of the impurity elements is less than 0.1%.

12. The heat sink according to claim 10, wherein a mass ratio of La, Cu, and Mn is 1:(0.4-24):(1-16).

13. The heat sink according to claim 10, wherein a mass ratio of Ce, La, Cu, Mg, and Mn is (2-20):1:(1-10):(0.2-20):(1-10).

14. The heat sink according to claim 10, wherein a mass sum of Cu and Mg is 0.06%-0.22% of the total mass of the aluminum alloy.

15. The heat sink according to claim 10, wherein a mass ratio of Ce and Fe is (0.02-0.2):1.

16. The heat sink according to claim 10, wherein a mass sum of Mg, Mn, and Zn is 0.03%-0.26% of the total mass of the aluminum alloy.

17. The heat sink according to claim 10, wherein a mass ratio of Sr, B, Ce, and La is (8-12):(0.6-4):(10-20):1.

18. The heat sink according to claim 10, wherein a yield strength of the aluminum alloy is in a range of 112 Mpa-131 Mpa, a tensile strength of the aluminum alloy is in a range of 220 Mpa-253 Mpa, an elongation of the aluminum alloy is in a range of 8%-15%, and a coefficient of thermal conductivity of the aluminum alloy is in a range of 201 W/(m k)-210 W/(m k).

* * * * *